US009616433B2

(12) United States Patent
Hayata et al.

(10) Patent No.: US 9,616,433 B2
(45) Date of Patent: Apr. 11, 2017

(54) SHOWER APPARATUS

(71) Applicant: TOTO LTD., Fukuoka (JP)

(72) Inventors: Shuhei Hayata, Kitakyushu (JP); Koji Takeda, Kitakyushu (JP); Yasufumi Uemura, Kitakyushu (JP); Kiyotake Ukigai, Kitakyushu (JP); Katsuya Nagata, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 14/671,288

(22) Filed: Mar. 27, 2015

(65) Prior Publication Data

US 2015/0273488 A1 Oct. 1, 2015

(30) Foreign Application Priority Data

Mar. 31, 2014 (JP) ..... 2014-072840

(51) Int. Cl.

| | |
|---|---|
| ***B05B 7/10*** | (2006.01) |
| ***B05B 1/08*** | (2006.01) |
| ***B05B 1/18*** | (2006.01) |
| ***B05B 7/04*** | (2006.01) |

(52) U.S. Cl.

CPC ..... *B05B 1/083* (2013.01); *B05B 1/08* (2013.01); *B05B 1/18* (2013.01); *B05B 7/0425* (2013.01)

(58) Field of Classification Search

CPC ..... B05B 1/18; B05B 7/9425; E03C 1/084

USPC .... 239/399, 403, 428.5, 432, 463, 464, 491, 239/494, 496, 596

See application file for complete search history.

(56) References Cited

U.S. PATENT DOCUMENTS

| | | | | |
|---|---|---|---|---|
| 4,211,368 | A * | 7/1980 | Legros | A01C 23/042 239/315 |
| 5,143,295 | A * | 9/1992 | Okayama | B05B 1/34 239/403 |
| 6,557,785 | B1 * | 5/2003 | Knapp | B05B 7/0425 239/311 |
| 8,944,349 | B2 | 2/2015 | Ukigai et al. | |
| 2005/0284967 | A1 * | 12/2005 | Korb | B05B 1/18 239/552 |
| 2006/0163391 | A1 * | 7/2006 | Schorn | A61H 33/027 239/596 |
| 2007/0200013 | A1 * | 8/2007 | Hsiao | B05B 1/185 239/557 |
| 2011/0284662 | A1 * | 11/2011 | Ohashi | A47K 3/28 239/428.5 |
| 2012/0234943 | A1 * | 9/2012 | Ukigai | B05B 1/08 239/428.5 |

FOREIGN PATENT DOCUMENTS

JP 2012-187346 A 10/2012

* cited by examiner

*Primary Examiner* — Arthur O Hall
*Assistant Examiner* — Joel Zhou
(74) *Attorney, Agent, or Firm* — Studebaker & Brackett PC

(57) ABSTRACT

In this shower apparatus, a part of an internal space thereof closer to the outer circumference thereof than an aeration unit is defined as a plurality of small spaces, and all of the small spaces have a uniform channel resistance.

4 Claims, 6 Drawing Sheets

SHOWER APPARATUS

BACKGROUND

Field of the Invention

The present invention relates to a shower apparatus that discharges aerated bubbly water.

Description of Related Art

A shower apparatus which discharges bubbly water by aerating water using a so-called ejector effect is known. Such shower apparatus can reduce the amount of water usage via aeration. Meanwhile, such shower apparatus also reduces a stimulus sensation felt by a user when discharged bubbly water hits skin of the user, and this has been presented a problem in that a comfort feeling of the user of the shower apparatus is impaired.

In view of the above, the applicant has proposed the shower apparatus described in JP2012-187346 A. The shower apparatus described in JP2012-187346 A periodically varies the amount of air mixed into the water, whereby pulsation is provided to bubbly water to be discharged. Such pulsation is felt by the user of such shower apparatus as a stimulus sensation. As a result, a stimulus sensation reduced by aerating water to be discharged can be supplemented by such pulsation.

Further, the shower apparatus described in JP2012-187346 A periodically changes the direction of a main water stream ejected toward an aeration unit from a throttle unit comprised inside the shower apparatus, by the effect of a swirl formed in the vicinity of such main water stream, whereby the above-mentioned pulsation is provided to bubbly water to be discharged. More specifically, the direction of ejection of water from the throttle unit, the shape of a channel wall surface, etc., are devised such that a state in which the direction of a main water stream has been changed due to a negative pressure produced inside a swirl and a state in which the direction of a main water stream has returned due to a swirl reduced in size (in turn, a reduced negative pressure) are repeated in a self-induced and periodic manner. In this way, only a simple configuration allows bubbly water to be provided with self-induced pulsation, without separately providing a complicated mechanism, such as a pump for periodically varying the pressure of the shower stream.

However, in a shower apparatus having the configuration described in JP2012-187346 A, the phase and period of pulsation provided to bubbly water may differ depending on the position of a nozzle hole, resulting in unstable pulsation.

The possible reason for this problem is as set forth below. Regarding water that has been ejected radially from a throttle unit toward an outer circumference of the shower apparatus, most of such water is discharged to the outside as shower-like bubbly water; meanwhile, part of such water flows back toward a throttle unit through an inner space. Such backflow water is received in a swirl chamber and becomes a cause that generates a swirl in the vicinity of a main water stream. That is, the size of a swirl (size of a negative pressure) that varies the direction of a main water stream is affected by the flow rate of the backflow water.

If backflow water that flows from the direction of the outer circumference toward the inner circumference (i.e., backflow water that flows from all directions to the swirl chamber) has a uniform flow-rate distribution, the size of the swirl, and thus, the size of the negative pressure produced inside such swirl is also uniform in all directions, and the direction of the main water stream will therefore vary entirely with the same period and the same phase. As a result, uniform (same phase and same period) pulsation is provided to the entire bubbly water to be discharged, leading to the stable continuation of such pulsation.

However, for example, water streams ejected from the throttle unit toward different directions may interfere with each other, or some water streams may collide with inner wall surfaces of the shower apparatus, resulting in a non-uniform distribution of the flow rate of the backflow water that returns from the direction of the outer circumference to the swirl chamber. In such case, the size of a swirl that changes the direction of a main water stream, and the time when such swirl occurs, etc., will differ depending on the location, and the phase and period of pulsation provided to bubbly water are also not uniform in the entire shower apparatus (such phase and period will differ depending on the position of a nozzle hole). Pulsations with different phases may temporarily offset each other, and this causes unstable pulsation as a whole.

SUMMARY

The present invention has been made in view of the above problems, and has an object of providing a shower apparatus that is capable of imparting bubbly water with stable pulsation.

To solve the above problems, the present invention provides a shower apparatus that discharges aerated bubbly water, comprising: a water supply unit that supplies water; a throttle unit disposed downstream of the water supply unit, the throttle unit making a channel cross-sectional area smaller than that of the water supply unit and thereby increasing a flow velocity of water passing through the throttle unit to radially eject the water, as a main water stream, toward an outer circumference of the shower apparatus; an aeration unit disposed closer to the outer circumference than the throttle unit and provided with an opening for aerating water ejected through the throttle unit so as to produce bubbly water; a water discharge unit disposed further closer to the outer circumference than the aeration unit and provided with a plurality of nozzle holes for discharging the bubbly water; and a pulsation imparting unit that periodically changes a traveling direction of the main water stream and thereby periodically changes an amount of air mixed into the main water stream, so as to impart the bubbly water with pulsation, wherein a part of an internal space closer to the outer circumference than the aeration unit is defined as a plurality of small spaces, and after the bubbly water produced in the aeration unit flows into the respective small spaces, the bubbly water is discharged from the nozzle holes, wherein the pulsation imparting unit receives, in a swirl chamber, backflow water that returns from the small respective spaces toward the throttle unit so as to form a swirl in the vicinity of the main water stream, such that a negative pressure produced inside the swirl periodically changes the traveling direction of the main water stream, and wherein all of the small spaces have a uniform channel resistance.

The shower apparatus according to the present invention comprises the water supply unit, the throttle unit, the aeration unit and the water discharge unit. The water supply unit receives water supplied from the outside and supplies such water downstream. The throttle unit is disposed downstream of the water supply unit and serves as a channel that makes the channel cross-sectional area smaller than that in the water supply unit. The flow velocity of the water supplied form the water supply unit to the throttle unit is increased due to such smaller channel cross-sectional area, and the resultant water is radially ejected from the throttle unit toward the outer circumference (downstream). A flow of water ejected in this way from the throttle unit is also referred to as the "main water stream."

The aeration unit is disposed closer to the outer circumference than the throttle unit and is provided with an opening for aerating water ejected through the throttle unit so as to produce bubbly water. Air is introduced into the shower apparatus through the opening, and such air is mixed into a water main stream, whereby bubbly water is produced in the aeration unit.

The water discharge unit is disposed further closer to the outer circumference than the aeration unit and is provided with a plurality of nozzle holes for discharging bubbly water. Bubbly water produced in the aeration unit reaches the water discharge unit and is then discharged to the outside through the plurality of nozzle holes.

In this way, the shower apparatus according to the present invention discharges bubbly water, and thus, it is possible for a user to enjoy a shower stream with a voluminous feel while the amount of water usage is reduced.

The shower apparatus according to the present invention further comprises the pulsation imparting unit. The pulsation imparting unit periodically changes the traveling direction of a main water stream ejected from the throttle unit and thereby periodically changes the amount of air mixed into the main water stream in the aeration unit, so as to impart pulsation to the bubbly water to be discharged from the water discharge unit.

The amount of water discharged per unit of time from the water discharge unit is consistent, and thus, in the state of a large amount of air being mixed into a main water stream, the bubbly water discharged from the water discharge unit has a high flow velocity. Meanwhile, in the state of a small amount of air being mixed into a main water stream, the bubbly water discharged from the water discharge unit has a low flow velocity. As a result of such bubbly water being discharged at different flow velocities in an alternate manner, the bubbly water is imparted with pulsation, whereby a user feels a pulsating stimulus sensation.

Water (main water stream) ejected from the throttle unit becomes bubbly water and then reaches the water discharge unit, as described above. However, part of such bubbly water returns toward the throttle unit (downstream) without being discharged from the nozzle holes. Such water that flows backward in the shower apparatus is hereinafter also referred to as "backflow water."

The pulsation imparting unit periodically changes the traveling direction of a main water stream, taking advantage of the above-mentioned backflow water. More specifically, the pulsation imparting unit has a swirl chamber, and is configured to receive, in the swirl chamber, backflow water returning from the water discharge unit toward the throttle unit so as to form a swirl in the vicinity of the main water stream. A negative pressure is produced inside such formed swirl, and thus, the main water stream is attracted by such negative pressure.

A state in which the direction of the main water stream has been changed by a negative pressure and a state in which the direction of the main water stream has returned due to a reduced swirl (in turn, a reduced negative pressure) are repeated in a self-induced and periodic manner. In the aeration unit, along with the periodic change in the traveling direction of the main water stream, the amount of air mixed into the main water stream is also changed periodically. The frequency at which the traveling direction of the main water stream is changed is equal to the frequency of the pulsation imparted to the bubbly water.

Regarding the shower apparatus configured in such manner, it is considered that, due to, for example, a situation in which water streams ejected in different directions from the throttle unit interfere with each other or a situation in which some water streams collide with inner wall surfaces of the shower apparatus, backflow water that returns from the water discharge unit side toward the throttle unit may not have a uniform flow-rate distribution, as a whole, indicating that the flow rate varies depending on the direction in which the stream returns. As a result, it can be considered that bubbly water is not imparted with uniform pulsation, resulting in unstable pulsation.

In order to prevent this, the shower apparatus according to the present invention is configured such that part of the internal space closer to the outer circumference than the aeration unit is defined as a plurality of small spaces, and such that after the bubbly water produced in the aeration unit flows into the respective small spaces, the bubbly water is discharged from the nozzle holes.

The streams of bubbly water that have flown into the respective small spaces do not interfere with one another. The flow rate of the backflow water that returns from the respective small spaces is substantially determined by the channel resistance of each of the small spaces.

It should be noted that the "channel resistance of a small space" refers to the channel resistance that is received by an entire flow of bubbly water from when the bubbly water flows into a small space through an inlet thereof (inner circumferential end) and then flows through the small space toward the outer circumference until the bubbly water is discharged from a plurality of nozzle holes (all of the nozzle holes which communicate the small space with an external space). Further, the "backflow water returning from a small space" is not limited to backflow water that flows into a small space and then returns, and also encompasses backflow water that arrives at a part near an inlet of a small space and then returns without flowing into the small space.

The shower apparatus according to the present invention is configured such that all of the small spaces have a uniform channel resistance. With such configuration, the backflow water that returns from the respective small spaces toward the throttle unit consistently has a uniform flow rate among the streams of the backflow water. That is, although backflow water varies as time passes, the backflow water has a uniform flow rate at any point in time among the streams of the backflow water. Therefore, the swirl formed in the vicinity of the main water stream (and the negative pressure produced inside the swirl) has a uniform size. It is assumed here that the uniform channel resistance among the small spaces, the consistent and uniform flow rate among the streams of the backflow water, and the uniform size of the swirl formed in the vicinity of the main water stream, encompasses not only those involving perfect matching but also those being set so as to be capable of providing stable pulsation.

As a result, a main water stream is entirely attracted, at the same time point, by a negative pressure inside a swirl regardless of the direction of ejection. Therefore, the entire shower apparatus has a substantially uniform period and phase of pulsation imparted to bubbly water. Pulsations with different phases do not cancel each other out, and thus, stable pulsation can be imparted to bubbly water.

Further, in the shower apparatus according to the present invention, it is preferable that, when seen along a direction in which the bubbly water is discharged from the nozzle holes, all of the small spaces have a uniform distance that covers from a passage, through the swirl chamber, of water ejected from the throttle unit to an arrival of the water at an inlet of each of the small spaces. The uniform distance, among all of the small spaces, which covers from a passage, through the swirl chamber, of water ejected from the throttle unit to an arrival of the water at an inlet of each of the small spaces encompasses not only distances involving perfect matching but also distances being set so as to be capable of providing stable pulsation.

In the preferred aspect of the invention described above, when seen along a direction in which the bubbly water is discharged from the nozzle holes, all of the small spaces have a uniform distance that covers from a passage, through the swirl chamber, of water ejected from the throttle unit to an arrival of the water at an inlet of each of the small spaces. With such configuration, the streams of the backflow water which return from the respective small spaces will reach the swirl chamber after flowing upstream (toward the inner circumference) for a uniform distance. Therefore, even if the small spaces have different shapes, the backflow water that returns from the respective small spaces toward the throttle unit tends to have a uniform flow rate among the streams of the backflow water.

Further, in the shower apparatus according to the present invention, it is preferable that all of the small spaces have a uniform total opening area of the nozzle holes that communicate each of the small spaces with an external space. The uniform total opening area, among all of the small spaces, of the nozzle holes that communicate the small space with an external space encompasses not only opening areas involving perfect matching but also opening areas being set so as to be capable of providing stable pulsation.

In the preferred aspect of the invention described above, all of the small spaces have a uniform total opening area of the nozzle holes that communicate the small space with the external space. This allows all of the small spaces to have a more uniform channel resistance.

In the shower apparatus according to the present invention, it is also preferable that all of the small spaces have a uniform shape. The uniform shape among all of the small spaces encompasses not only shapes involving perfect matching but also shapes being set so as to be capable of providing stable pulsation.

In the preferred aspect of the invention described above, all of the small spaces have a uniform shape. As a result, the channel resistances received by the water ejected from the throttle unit before being discharged from the nozzle holes are completely the same in all directions of ejection. The backflow water that returns from the respective small spaces toward the throttle unit (to the swirl chamber) has a uniform flow rate among the streams of the backflow water, and the swirl formed in the vicinity of the main water stream (and size of the negative pressure produced inside the swirl) has a uniform distribution of size in all directions. Therefore, more stable pulsation can be imparted to the bubbly water.

DETAILED DESCRIPTION OF PREFERRED EMBODIMENTS

Figure 1:
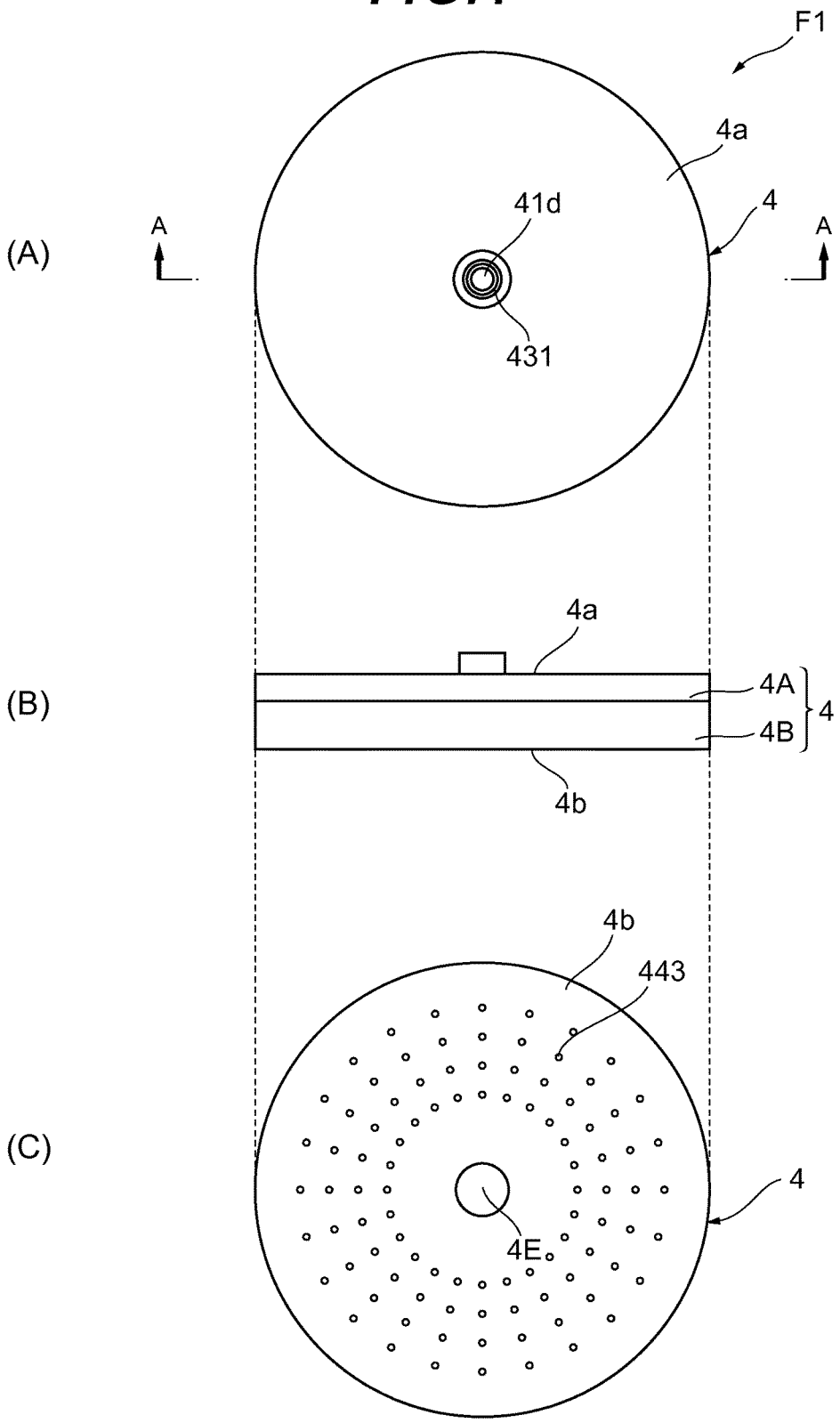
FIG. 1A is a plan view showing a shower apparatus according to an embodiment of the present invention.
FIG. 1B is a side view showing the shower apparatus according to an embodiment of the present invention.
FIG. 1C is a bottom view showing the shower apparatus according to an embodiment of the present invention.

Embodiments of the present invention will now be described below with reference to the accompanying drawings. To facilitate understanding of the description, the same components in the respective drawings are denoted by the same reference numerals whenever possible and repetitive description thereof will be omitted.

A shower apparatus, which is an embodiment of the present invention, will now be described with reference to FIGS. 1A, 1B and 1C, which are diagrams showing a shower apparatus F1 according to an embodiment of the present invention, in which FIG. 1A is a plan view, FIG. 1B is a side view, and FIG. 1C is a bottom view. As shown in FIG. 1A, the shower apparatus F1 is constituted by a body 4 which forms a circular shape in a top view, and a water supply port 41*d* is formed in a top face 4*a* of the shower apparatus F1 (body 4). The water supply port 41*d* is an inlet for water that is supplied from the outside.

As shown in FIG. 1B, the body 4 of the shower apparatus F1 has an external shape formed of: a cavity plate 4A serving as an upper part of the body 4; and a shower plate 4B serving as a lower part thereof. As shown in FIG. 10, a plurality of nozzle holes 443 is formed in a bottom face 4*b* of the body 4, and a sealing piece 4E is disposed in the bottom face 4*b*. Shower water (bubbly water) to be discharged from the shower apparatus F1 is discharged from the respective nozzle holes 443 in a direction perpendicular to the bottom face 4*b*. It should be noted that the nozzle holes 443 are not arranged in the entire bottom face 4*b*, but instead, are arranged only in an outer circumferential region thereof which excludes a center region thereof.

As shown in FIG. 1A, the top face 4*a* of the body 4 is provided with a circular through-hole 431 that surrounds the water supply port 41*d*. An internal space (space through which water passes) of the shower apparatus F1 communicates with external air via the through hole 431. When water is supplied to the shower apparatus F1 via the water supply port 41*d*, an ejector effect is produced, whereby external air flows into the internal space of the shower apparatus F1 via the through-hole 431. Water in the internal space is aerated so as to be bubbly water, and the resultant water is then discharged to the outside via the nozzle holes 443.

Figure 2:
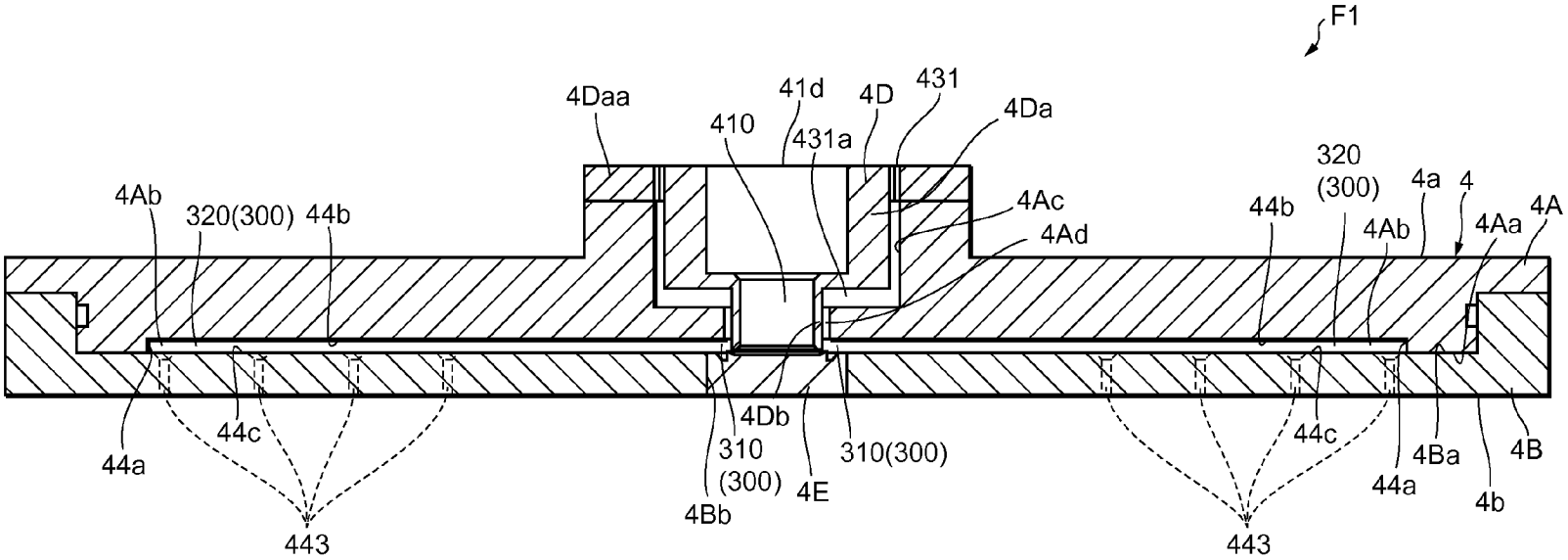
FIG. 2 is a sectional view taken along line A-A in FIG. 1A.

Next, the shower apparatus F1 will be described with reference to FIG. 2, which is a sectional view taken along line A-A in FIG. 1A. As shown in FIG. 2, the shower apparatus F1 is comprised of the cavity plate 4A, the shower plate 4B, an introduction piece 4D and the sealing piece 4E.

The cavity plate 4A is a member which forms the external shape of the body 4 together with the shower plate 4B. In the cavity plate 4A, a concave portion 4Ab, which is circular in shape, is formed in a contact surface 4Aa, which is a surface of the cavity plate 4A on the side opposite to the top face 4*a* of the body 4, so as to extend toward the top face 4*a*. A bottom surface (surface parallel to the top face 4*a*) of the concave portion 4Ab serves as a top wall 44*b* of an internal space (hereinafter referred to as the "space 300") that is formed inside the concave portion 4Ab.

The shower plate 4B is a member which forms the external shape of the body 4 together with the cavity plate 4A, and a plurality of nozzle holes 443 is formed in the shower plate 4B. In the region in which the nozzle holes 443 are formed, a contact surface 4Ba, which is a surface of the shower plate 4B on the side opposite to the bottom face 4*b*, is configured to serve as a bottom wall 44*c* of the space 300.

The space 300 is formed as a disk-shaped space that is sandwiched between the top wall 44*b* and the bottom wall 44*c*, which are parallel to each other. The contact surface 4Ba of the shower plate 4B and the contact surface 4Aa of the cavity plate 4A make contact with each other, and an O-ring (not shown) is inserted between these contact surfaces. The O-ring keeps the shower plate 4B and the cavity plate 4A watertight.

The introduction piece 4D has a large-diameter portion 4Da and a small-diameter portion 4Db. The above-described water supply port 41*d* is formed at an end (upper end) of the large-diameter portion 4Da on the side opposite to the small-diameter portion 4Db. The large-diameter portion 4Da has an internal channel 410 formed therein, which is a cylindrical space to communicate with the water supply port 41*d*, and this space serves as the water supply unit 41. The internal channel 410 corresponds to a water supply unit of the present invention.

The large-diameter portion 4Da has a flange 4Daa formed at an end thereof where the water supply port 41*d* is formed. The above-described through-hole 431 is formed in the flange 4Daa to extend through the flange 4Daa in the thickness direction.

From a top view, a concave portion 4Ac, which is circular in shape, is formed at the center of the cavity plate 4A, and a through-hole 4Ad, which is circular in shape, is formed at the bottom center of the concave portion 4Ac. The introduction piece 4D is housed in the concave portion 4Ac and the through-hole 4Ad. The small-diameter portion 4Db of the introduction piece 4D is housed in the through-hole 4Ad and arranged to protrude downward from the through-hole 4Ad and face the sealing piece 4E. The large-diameter portion 4Da of the introduction piece 4D is housed in the concave portion 4Ac, and the flange 4Daa comes into contact with an outer edge of the concave portion 4Ac so as to cover the cavity plate 4A from above.

A space is formed between the large-diameter portion 4Da and the concave portion 4Ac and between the small-diameter portion 4Db and the through-hole 4Ad, and serves as an air channel 431*a*. The air channel 431*a* allows the through-hole 431 and the space 300 to communicate with each other. An end (lower end) of the air channel 431*a* on the side close to the space 300 is opened so as to serve as an air introduction port 431*b*.

Figure 3:
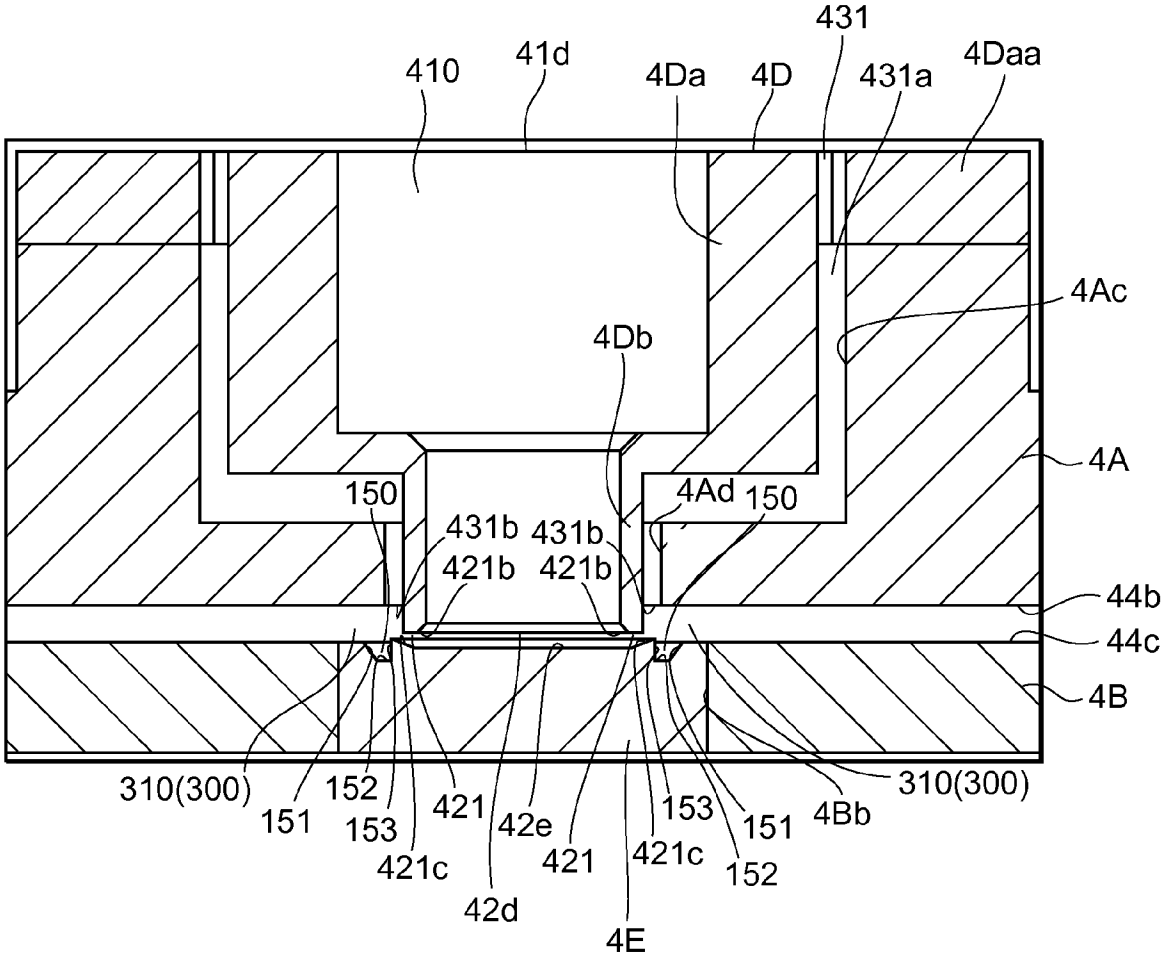
FIG. 3 is a view magnifying and showing a part of the section shown in FIG. 2.

Explanation will now continue to be provided with reference to FIG. 3. FIG. 3 is an enlarged view of a part (center part) of the cross-section shown in FIG. 2.

The sealing piece 4E is engaged in a through-hole 4Bb formed at the center of the shower plate 4B. A water-guiding concave portion 42*e* is formed at the center of a surface of the sealing piece 4E on the side (upper side) close to the introduction piece 4D, and a slope 421*c* is formed at an outer circumferential end of the water-guiding concave portion 42*e*. The slope 421*c* is formed as a gradually ascending slope extending from the bottom surface of the water-guiding concave portion 42*e*. The slope 421*c* is arranged such that it faces an end surface 421*b* of the small-diameter portion 4Db of the introduction piece 4D, and the end surface 421*b* is parallel to the bottom surface of the water-guiding concave portion 42*e*. A throttle channel 421 is formed as a channel defined by the slope 421*c* and the end surface 421*b*. The internal channel 410 and the space 300 communicate with each other via the throttle channel 421.

The throttle channel 421 is defined by the end surface 421*b* and the slope 421*c*, as mentioned above, and thus, the channel direction is not a direction parallel to the bottom wall 44*c*, but a direction that is slightly inclined with respect to the bottom wall 44*c* such that the direction becomes further away from the bottom wall 44*c* and closer to the top wall 44*b* on a more downstream side (further outer circumferential side).

When the shower apparatus F1 is supplied with water from the water supply port 41*d*, such water reaches the lower end of the small-diameter portion 4Db through the internal channel 410 and is then ejected radially from the throttle channel 421 toward the space 300. The throttle channel 421 has a cross-sectional area smaller than that of the internal channel 410. Thus, the flow velocity of the water ejected from the throttle channel 421 is higher than that of the water passing through the internal flow path 410. The flow of water ejected from the throttle channel 421 to the space 300 is hereinafter also referred to as the "main water stream MF."

As described above, the cavity plate 4A has the air channel 431*a* formed therein. The air introduction port 431, which is a downstream end of the air channel 431*a*, is formed at a position close to the center of the top wall 44*b* so as to circularly surround the outer circumference of the small-diameter portion 4Db.

When water is ejected from the throttle channel 421, air from the air introduction port 431*b* (external air that has entered via the through-hole 431) is mixed into the main water stream MF due to an ejector effect, resulting in the production of bubbly water. More specifically, a gas-liquid interface is formed downstream of (closer to the outer circumference than) the throttle channel 421, and the ejected water enters the gas-liquid interface to take in air. As a result, bubbly water is produced. A part of the space 300 near the air introduction port 431*b* is hereinafter also referred to as the "aeration unit 310." As is apparent from the above description, the aeration unit 310 is arranged to surround the outer circumference of the throttle channel 421.

The bubbly water produced in the aeration unit 310 further flows, through the space 300, toward the outer circumference and is then discharged to the outside from the respective nozzle holes 443. A part (outer circumferential part) of the shower plate 4B where the plurality of nozzle holes 443 is formed and an outer circumferential part of the space 300, which is located immediately thereabove, are hereinafter and collectively also referred to as the "water discharge unit 320." As is apparent from the above description, the water discharge unit 320 is arranged so as to surround the outer circumference of the aeration unit 310.

In the shower apparatus F1, the traveling direction of water (main water stream) ejected from the throttle channel 421 is varied periodically, whereby the mixed air ratio of the bubbly water produced in the aeration unit 310 is varied periodically. Such periodic variation of the mixed air ratio brings a shower stream discharged from the water discharge unit 320 into a pulsating state. As a result, a user will be able to obtain a stimulus sensation.

Figure 4:
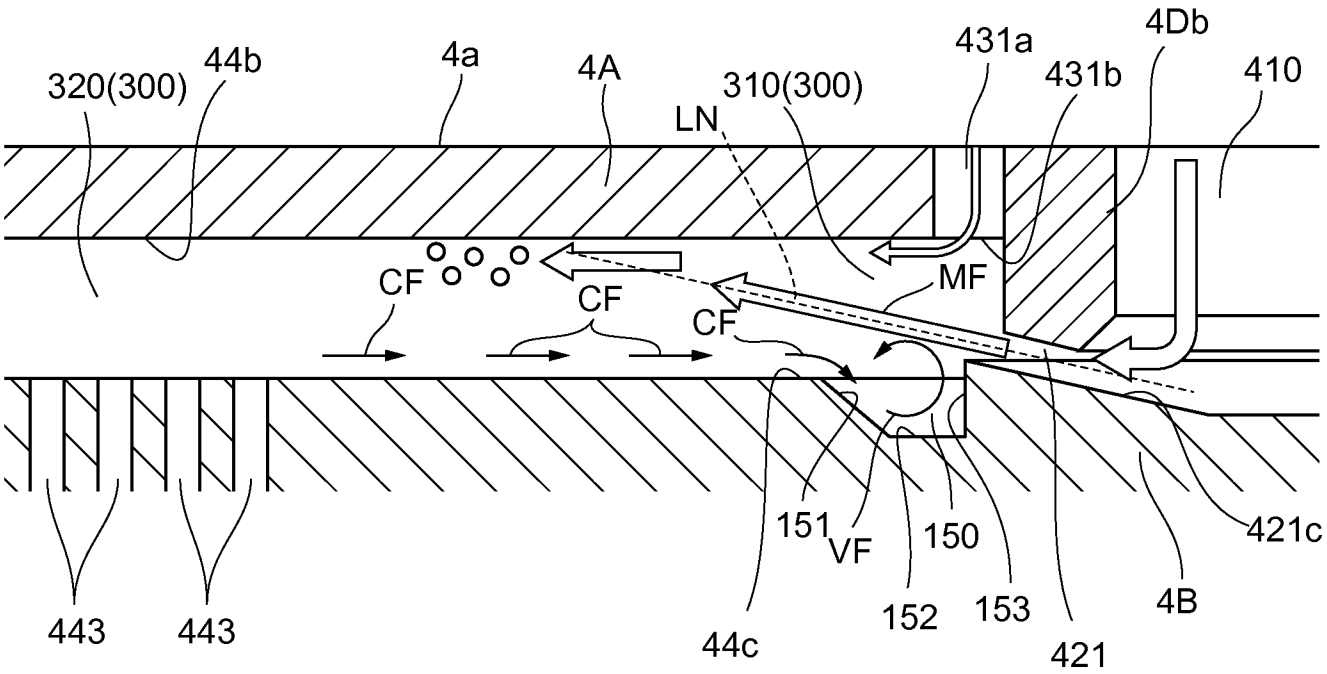
FIG. 4 is a diagram explaining the mechanism of imparting pulsation to water to be discharged in the shower apparatus shown in FIG. 1A.
Figure 5:
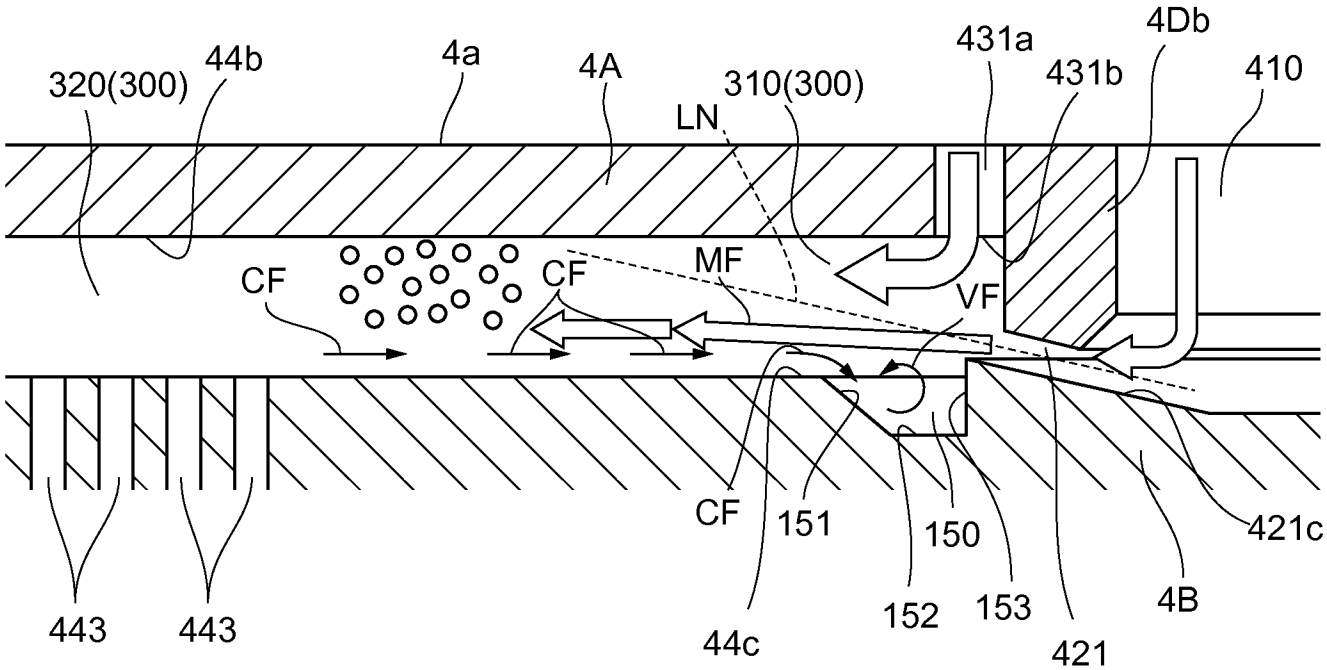
FIG. 5 is a diagram explaining the mechanism of imparting pulsation to water to be discharged in the shower apparatus shown in FIG. 1A.

Next, the mechanism of changing the mixed air ratio periodically will be described with reference to FIGS. 4 and 5, which are enlarged views of the throttle channel 421, and its vicinity, and which schematically illustrate how the mixed air ratio changes over time. FIG. 4 shows an initial state in which water starts to be ejected through the throttle channel 421. FIG. 5 shows a state in which the mixed air ratio has been changed and increased so as to be the maximum value.

First, as can be seen from FIG. 4, the water ejected through the throttle channel 421 toward the aeration unit 310 travels upward along the throttle channel 421 so as to form a main water stream MF. Here, the traveling direction of the main water stream MF in the aeration unit 310 matches the traveling direction (direction along a dotted line LN) of the water flowing inside the throttle channel 421, that is, it matches the channel direction of the throttle channel 421.

The main water stream MF ejected from the throttle channel 421 allows a majority part of the aeration unit 310, which excludes a part near the air introduction port 431*b*, to be filled with water. In the aeration unit 310, a gas-liquid interface (not shown) is formed between an air-filled part near the air introduction port 431*b* and a water-filled part located downstream of the former part (the outer circumferential part of the space 300).

The outer circumferential part of the space 300 is filled with water, as described above, and the water ejected from the throttle channel 421 is supplied thereto, and therefore, the water pressure in the water discharge unit 320 rises. Due to such water pressure, high-speed water streams are discharged from the respective nozzle holes 443. However, the water ejected from the throttle channel 421 is not entirely discharged from the nozzle holes 443. Part of the water that has reached the water discharge unit 320 or its vicinity flows back toward the throttle channel 421 along the bottom wall 44*c*. Such water that flows back and returns inside the space 300 is hereinafter also referred to as the "backflow water CF."

As shown in FIG. 4, a swirl chamber 150 is formed at a position of the bottom wall 44*c* close to the center thereof. The swirl chamber 150 refers to a groove formed by retracting part of the bottom wall 44*c* and is formed so as to circularly surround the throttle channel 421 in a top view.

The swirl chamber 150 is defined by an outer surface 151, a bottom surface 152 and an inner surface 153. The outer surface 151 is a surface that defines the outer circumference of the swirl chamber 150, which serves as a concave space, and forms a surface inclined to the bottom wall 44*c*, as shown in FIG. 4. The bottom surface 152 is a surface that defines the bottom of the swirl chamber 150, which serves as a concave space, and forms a surface parallel to the bottom wall 44*c*, as shown in FIG. 4. The inner surface 153 is a surface that defines the inner circumference of the swirl chamber 150, which serves as a concave space, and forms a surface perpendicular to the bottom wall 44*c*, as shown in FIG. 4.

The backflow water CF that returns toward the throttle channel 421 along the bottom wall 44*c* flows into the swirl chamber 150 along the outer surface 151 and then flows along the bottom surface 152 and the inner surface 153 sequentially. Further, as stated above, the main water stream MF exists in an upper part (part close to the top wall 44*b* ) of the swirl chamber 150. Due to the influence of the backflow water CF flowing into the swirl chamber 150 and the main water stream MF, a swirl-like flow (hereinafter referred to as the "swirl water stream VF") is produced in the swirl chamber 150.

In the state of FIG. 4, which is an initial state in which water starts to be ejected through the throttle channel 421, the traveling direction of the main water stream MF is directed toward the top wall 44*b*. Therefore, as shown in FIG. 4, a relatively large swirl water stream VF is formed in the swirl chamber 150.

An outward force (centrifugal force) acts on the water existing inside the swirl water stream VF, and as a result, an internal water pressure of the swirl water stream VF becomes lower than an ambient water pressure (becomes a negative pressure). Further, such decrease in water pressure becomes more remarkable as the swirl water stream VF becomes larger. In other words, as the swirl water stream VF becomes larger, the negative pressure produced inside the swirl water stream VF becomes higher. Therefore, in the state, as shown in FIG. 4, in which the swirl water stream VF is formed so as to be relatively large, a high negative pressure is produced in a lower part of the main water stream MF (on a side close to the bottom wall 44*c*).

After the state of FIG. 4, the main water stream MF is attracted by a high negative pressure produced inside the swirl water stream VF and the direction of the main water stream MF is changed so as to be away from the air introduction port 431*b*. The swirl water stream VF becomes smaller as the traveling direction of the main water stream MF is changed so as to be further away from the air introduction port 431*b* (closer to the swirl chamber 150). FIG. 5 shows a state in which, as a result of a change in the traveling direction of the main water stream MF, the main water stream MF is furthest away from the air introduction port 431*b*.

In the state of FIG. 5, with the increased distance between the main water stream MF and the air introduction port 431*b*, the position of the gas-liquid interface (not shown) formed in the aeration unit 310 is closer to the outer circumference (left side in FIG. 5) than the position of the gas-liquid interface in the state of FIG. 4. The air introduced into the aeration unit 310 through the air introduction port 431*b* heads for the gas-liquid interface while being accelerated by the main water stream MF; however, as a result of the above change in the position of the gas-liquid interface toward the outer circumference, the acceleration distance is increased. As a result, in the state of FIG. 5, the amount of air introduced through the air introduction port 431*b* and taken into the water (amount of mixed air) is at a maximum. In other words, the mixed air ratio of bubbly water discharged from the nozzle holes 443 has the maximum value.

In the state of FIG. 5, the traveling direction of the main water stream MF is the closest to the swirl chamber 150. Thus, the swirl water stream VF formed closed to the swirl chamber 150 has the minimum size, and the negative pressure produced inside the swirl water stream VF is at the minimum. Therefore, after the state of FIG. 5, the traveling direction of the main water stream MF which has been attracted by the negative pressure returns to its original state, and then matches the traveling direction (direction along a dotted line LN) of the water flowing inside the throttle channel 421, as shown in FIG. 4.

In the state of FIG. 4, the distance between the main water stream MF and the air introduction port 431*b* is short, and thus, the position of the gas-liquid interface (not shown) formed in the aeration unit 310 has been changed to be closer to the inner circumference than the position of the gas-liquid interface in the state of FIG. 5. The air introduced into the aeration unit 310 through the air introduction port 431*b* travels toward the gas-liquid interface while being accelerated by the main water stream MF; however, as a result of the above change of the position of the gas-liquid interface toward the inner circumference, the acceleration distance is decreased. As a result, in the state of FIG. 4, the amount of air introduced through the air introduction port 431*b* and taken into the water (amount of mixed air) is at a minimum. In other words, the mixed air ratio of bubbly water discharged from the nozzle holes 443 has the minimum value.

As is apparent from the above description, in the shower apparatus F1 according to the present embodiment, the state of FIG. 4 and the state of FIG. 5 are repeated alternately, whereby the ratio of the mixed air in the bubbly water discharged from the nozzle holes 443 is changed periodically. The amount of water discharged from the water discharge unit 320 per unit of time is held constant, and thus, in the state (state of FIG. 5) in which the amount of air mixed into the main water stream MF is large, the flow velocity of bubbly water discharged from the nozzle holes 443 is high. Meanwhile, in the state (state of FIG. 4) in which the amount of air mixed into the main water stream MF is small, the flow velocity of bubbly water discharged from the nozzle holes 443 is low. In this way, bubbly water is discharged from the nozzle holes 443 at different flow velocities in an alternate manner. Density irregularities appear in the water discharged from the nozzle holes 443, and the resultant water intermittently hits the skin of the user of the shower apparatus F1. As a result, the user of the shower apparatus F1 feels a pulsating stimulus sensation.

The frequency of the above pulsation changes in accordance with the flow rate of the backflow water CF received in the swirl chamber 150. For example, if the flow rate of the backflow water CF becomes higher, the formed swirl water stream VF also becomes large, resulting in the production of high negative pressure inside the swirl water stream VF. Upon receiving a large force, the direction of the main water stream MF is changed quickly, and thus, the period of the change of direction of the main water stream MF becomes short while the frequency of the pulsation provided to the bubbly water becomes high. Conversely, if the flow rate of the backflow water CF becomes low, the formed swirl water stream VF also becomes small, resulting in the production of low negative pressure inside the swirl water stream VF. Upon receiving a small force, the direction of the main water stream MF is changed relatively slowly, and thus, the period of the change of direction of the main water stream MF becomes long while the frequency of pulsation provided to the bubbly water becomes low.

The main water stream MF is radially ejected from the throttle channel 421 toward the outer circumference. Therefore, the backflow water CF returns to the swirl chamber 150 in all directions in a top view. At this point, as long as the backflow water CF has a uniform flow-rate distribution (as long as the backflow water CF has a uniform flow rate among the streams of the backflow water CF, regardless of the rerun direction), the size of the swirl water stream VF formed below the main water stream MF (size in the negative pressure) is uniform in all directions, regardless of the direction of ejection of the main water stream MF in a top view.

However, inside the shower apparatus F1, for example, water streams ejected from the throttle channel 421 toward different directions may interfere with each other, or some water streams may collide with inner wall surfaces of the shower apparatus F1, resulting in a non-uniform distribution of the flow rate of the backflow water CF that returns to the swirl chamber 150. In such case, the size of the swirl water stream VF that changes the direction of the main water stream MF, and the time when such swirl occurs, etc., will differ depending on the location, and the phase and period of pulsation provided to the bubbly water will also not be uniform in the entire shower apparatus F1 (such phase and period will differ depending on the position of the nozzle hole 443). Pulsations with different phases may temporarily offset each other, and this causes unstable pulsation as a whole.

Then, in the shower apparatus F1, an outer circumferential part of the space 300 is defined as a plurality of small spaces 330, and such configuration prevents the occurrence of the above-described event.

Figure 6:
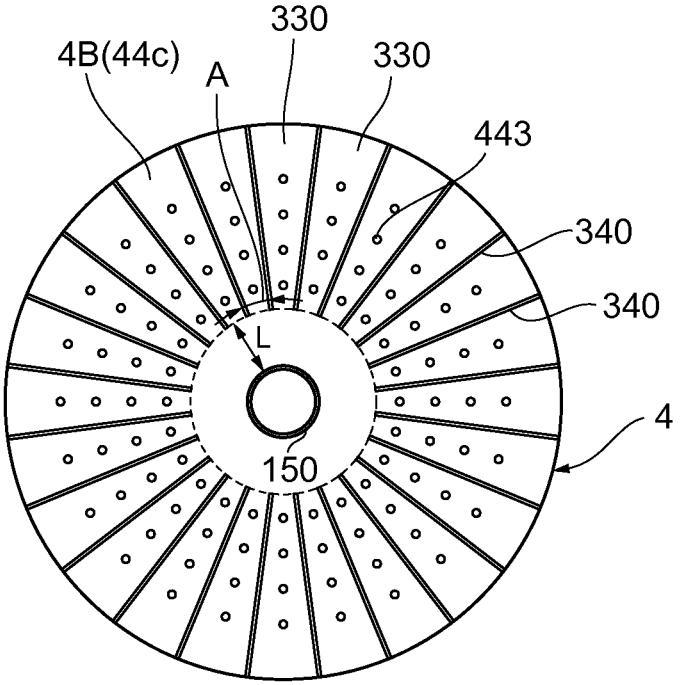
FIG. 6 is a view showing a plurality of small spaces formed inside the shower apparatus shown in FIG. 1A.

FIG. 6 is a view showing the plurality of small spaces 330 formed inside the shower apparatus F1 and is also a schematic view in which the shower plate 4B and the space 300 thereabove are seen from an upper surface side (bottom wall 44*c* side). As shown in FIG. 6, an outer circumferential part of the space 300, more specifically, a part of the space 300 closer to the outer circumference than the aeration unit 310, is defined as the plurality of small spaces 330 (331-346) by a plurality of partition walls 340. After the bubbly water produced in the aeration unit 310 flows into the respective small spaces 330, the bubbly water is discharged from the nozzle holes 443.

The small spaces 330 each constitute a linear channel and are arranged radially such that the channel direction extends along the direction of ejection of water from the throttle channel 421. The space 300 is defined such that the respective small spaces 330 include the same number (four in the present embodiment) of nozzle holes 443 from a top view.

The streams of bubbly water that have flown into the respective small spaces 330 do not interfere with one another. The flow rate of the backflow water CF that returns from the small spaces 330 is substantially determined by the channel resistance, etc., of each of the small spaces 330. It should be noted that the "channel resistance of a small space 300" refers to a channel resistance that is received by an entire stream from when bubbly water flows into the small space 300 through an inlet thereof (inner circumferential end) and then flows through the small space 300 toward the outer circumference until the bubbly water is discharged from the plurality of nozzle holes 443 (all of the nozzle holes 443 which communicate the small space 330 with the external space). Further, the "backflow water returning from a small space 300" is not limited to backflow water CF that flows into the small space 330 and then returns, and also encompasses backflow water CF that arrives at a part near an inlet of the small space 330 and then returns without flowing into the small space 300.

The shower apparatus F1 according to the present embodiment is configured such that all of the small spaces 300 have a uniform channel resistance. With such configuration, the backflow water CF that returns from the respective small spaces 300 to the swirl chamber 150 consistently has a uniform flow rate among the streams of the backflow water CF. That is, although the flow rate of the backflow water CF varies as time passes, the backflow water CF has a uniform flow rate at any point in time among the streams of the backflow water CF. Therefore, the size of the swirl water stream VF formed in the vicinity of the main water stream MF (and the size of the negative pressure produced inside the swirl water stream VF) is uniform in all directions.

As a result, the main water stream MF is entirely attracted, at the same time point, by the negative pressure inside the swirl water stream VF regardless of the direction of ejection in a top view. Therefore, the entire shower apparatus F1 has a substantially uniform period and phase of pulsation imparted to the bubbly water. Pulsations with different phases do not cancel each other out, and thus, stable pulsation can be imparted to the bubbly water.

Various aspects can be considered in which all of the small spaces 300 have a uniform channel resistance. As one such example, in the present embodiment, when seen along a direction in which the bubbly water is discharged from the nozzle holes 443, all of the small spaces 330 have a uniform distance that covers from a passage, through the swirl chamber 150, of water ejected from the throttle channel 421 to an arrival of the water at an inlet of each of the small spaces 330 (such distance being indicated by an arrow L in FIG. 6). With such configuration, the streams of the backflow water CF which return from the respective small spaces 330 will reach the swirl chamber 150 after flowing upstream (toward the inner circumference) for a uniform distance. Therefore, the backflow water CF that returns from the small spaces 330 to the swirl chamber 150 has a uniform flow-rate distribution which does not result in variations in flow rates.

Further, in the present embodiment, all of the small spaces 330 have a uniform total opening area of the nozzle holes 443 that communicate each of the small spaces 330 with the external space (from a top view, the total sum of the opening areas of the nozzle holes 443 included in each of the small spaces 330).

In addition, in the present embodiment, all of the small spaces 330 have a uniform shape. As a result, the channel resistance received by the water ejected from the throttle channel 421 before being discharged from the nozzle holes 443 is completely uniform in all directions of ejection. The backflow water CF that returns from the respective small spaces 330 to the swirl chamber 150 has a substantially uniform flow rate among the streams of the backflow water CF, and the size of the swirl water stream VF formed in the vicinity of the main water stream MF (and the size of the negative pressure produced inside the swirl water stream VF) is uniform in all directions. Therefore, stable pulsation can be imparted to the bubbly water.

Embodiments of the present invention have been described above with reference to concrete examples. However, the present invention is not limited to these examples. That is, when those skilled in the art make design changes to any of the examples, the resulting variations are also included in the scope of the present invention as long as the variations contain the features of the present invention. For example, the components of the above-described examples as well as the arrangements, materials, conditions, shapes, sizes, and the like of the components are not limited to those illustrated above, and may be changed as required. Also, the components of the above-described embodiments may be combined as long as it is technically possible, and the resulting combinations are also included in the scope of the present invention as long as the combinations contain the features of the present invention.

What is claimed is:

1. A shower apparatus that discharges aerated bubbly water, comprising:

a water supply unit that supplies water;

a single throttle unit disposed downstream of the water supply unit, the single throttle unit making a channel cross-sectional area smaller than that of the water supply unit and thereby increasing a flow velocity of water passing through the single throttle unit to radially eject the water, as a single main water stream, toward an outer circumference of the shower apparatus;

an aeration unit disposed closer to the outer circumference than the single throttle unit and provided with an opening for aerating water ejected through the single throttle unit so as to produce bubbly water;

a water discharge unit disposed further closer to the outer circumference than the aeration unit and provided with a plurality of nozzle holes for discharging the bubbly water;

a pulsation imparting unit, which has a swirl chamber facing the opening, provided in the vicinity of the single main water stream, that periodically changes a traveling direction of the single main water stream by a swirl formed in the swirl chamber, and thereby periodically changes an amount of air mixed into the single main water stream, so as to impart the bubbly water with pulsation; and a plurality of partition walls which define a part of an internal space closer to the outer circumference than the opening and the swirl chamber as a plurality of small spaces, wherein the plurality of small spaces is configured such that all of the small spaces have a uniform channel resistance, and wherein the partition walls extend from the outer circumference of the shower apparatus towards the swirl chamber such that streams of the bubbly water that flow into the small spaces do not interfere with one another.

2. The shower apparatus according to claim 1, wherein, when seen along a direction in which the bubbly water is discharged from the nozzle holes, all of the small spaces have a uniform distance that covers from a passage, through the swirl chamber, of water ejected from the single throttle unit to an arrival of the water at an inlet of each of the small spaces.

3. The shower apparatus according to claim 2, wherein all of the small spaces have a uniform total opening area of the nozzle holes that communicate the small space with an external space.

4. The shower apparatus according to claim 3, wherein all of the small spaces have a uniform shape.

* * * * *